US007367172B2

(12) United States Patent
Conti

(10) Patent No.: US 7,367,172 B2
(45) Date of Patent: May 6, 2008

(54) PACKAGING MACHINE FOR MAKING AND PACKAGING ARTICLES CONTAINING A PRODUCT FOR INFUSION

(75) Inventor: Roberto Conti, Imola (IT)

(73) Assignee: I.M.A. Industria Macchine Automatiche S.p.A., Bologna (IT)

( * ) Notice: Subject to any disclaimer, the term of this patent is extended or adjusted under 35 U.S.C. 154(b) by 0 days.

(21) Appl. No.: 10/588,504

(22) PCT Filed: Dec. 14, 2005

(86) PCT No.: PCT/IB2005/003938

§ 371 (c)(1),
(2), (4) Date: Aug. 4, 2006

(87) PCT Pub. No.: WO2006/067616

PCT Pub. Date: Jun. 29, 2006

(65) Prior Publication Data

US 2007/0062154 A1 Mar. 22, 2007

(30) Foreign Application Priority Data

Dec. 20, 2004 (IT) ..... BO2004A0784

(51) Int. Cl.
*B65B 9/02* (2006.01)
*B65B 29/02* (2006.01)
*B65B 35/50* (2006.01)

(52) U.S. Cl. ..... 53/553; 53/122
(58) Field of Classification Search ..... 53/553, 53/122
See application file for complete search history.

(56) References Cited

U.S. PATENT DOCUMENTS 5,233,813 A * 8/1993 Kenney et al. ..... 53/450
5,459,980 A * 10/1995 Kenney et al. ..... 53/450
6,122,894 A * 9/2000 Romagnoli ..... 53/51
2002/0139086 A1* 10/2002 Ghirlandi ..... 53/413

FOREIGN PATENT DOCUMENTS

EP 0 791 537 A1 8/1997
EP 0 806 353 A1 11/1997
EP 1 532 466 A2 10/2005
WO 96/233695 A1 8/1996
WO 99/37542 A1 7/1999

* cited by examiner

*Primary Examiner*—Stephen F. Gerrity
(74) *Attorney, Agent, or Firm*—Arent Fox LLP

(57) ABSTRACT

Described is a machine (5) for making and packaging articles (1) containing infusion product, the machine (5) being of the type defined by a production line (A) comprising a plurality of operating stations located one after the other and designed to make at least one continuous strip (S) by superposing and sealing two webs of filter paper with measured quantities or charges (4) of infusion product interposed between them at regular intervals; and at least one cutting station (6) for dividing up the strip (S) to form a succession of individual articles (1). The machine (5) further comprises at least one built-in packaging station (8, 8*a*) for packaging groups of the articles (1) in bag-like packets (10). The built-in packaging station (8, 8*a*) is located immediately downstream of the cutting station (6) and comprises a packaging device (9) for making up stacks (1*a*, 1*b*) with the articles (1) and 15 a transfer device (11) which guides the stacks (1*a*, 1*b*) of articles (1) along a vertical feed path section (Z) transversal to the production line (A) and feeds them into the bag-like packets (10).

26 Claims, 20 Drawing Sheets

PACKAGING MACHINE FOR MAKING AND PACKAGING ARTICLES CONTAINING A PRODUCT FOR INFUSION

TECHNICAL FIELD

The present invention relates to a packaging machine for making and packaging articles containing a product for infusion.

In particular, the invention is advantageously used for the production, and for the packaging into bag-like packets, of stacked groups of single-use pods of filter paper containing measured quantities or charges of infusion product such as tea, barley coffee, camomile and the like, preferably powdered coffee, to which this specification expressly refers but without thereby restricting the scope of the invention.

BACKGROUND ART

Usually, an automatic machine for making filter-paper pods, containing doses of infusion product comprises a production line having a plurality of operating stations located one after the other along it and at the end of which a continuous strip of pods, that is to say, two superposed webs of filter paper heat sealed to each other and having interposed, at regular intervals, a plurality of infusion product charges, is divided up at a cutting station into individual single-use pods separated by waste material.

Downstream of the cutting station, the pod making machine has an end outfeed station equipped with pick and place means designed for picking up the pods one by one and placing them on conveyors that transport them to packaging units which wrap them in respective heat-sealed overwraps. In another solution, which this invention specifically refers to, the outfeed station comprises handling means for stacking groups of pods and transporting the pod stacks to a packaging unit where each pod stack is picked up and fed by a multiplicity of complex mechanical devices into a forming assembly which packs it into a bag-like packets.

For example, in a prior art solution described in International Patent Application PCT WO 99/37542, the pods are packaged by placing two or more pod stacks in a carriage mounted on a conveyor track. The carriage transports the stacks to a remote packaging station equipped with suitable means for picking up one or more pod stacks from the carriage and placing them in a packet previously opened at the top. The packet is then closed by suitable sealing means and transported to outfeed reservoirs.

In other words, packaging stacked groups of pods requires conveyor means for handling and moving the pods from the machine that makes them to the packaging unit, which is often located some distance away.

Structures of this kind have considerable disadvantages due not only to the presence of the handling/conveyor means required to transport the stacked pods to the packaging units, which greatly increase the overall dimensions of the pod making machines that mount them, but also and above all to the complexity of the components of the packaging units themselves, such as, in the aforementioned international PCT patent application, the conveyor carriages, the guide tracks for the carriages and the pod pick and place means.

Other major difficulties are caused by the handling and positioning of the pod stacks since the pods are gravity fed into the bags leading to their being incorrectly arranged in the bags.

The present invention has for an object to overcome the above mentioned disadvantages by providing an infusion pod making machine equipped with a built-in packaging unit and combining high productivity and quality pod packaging capabilities in a compact structure.

DISCLOSURE OF THE INVENTION

Accordingly, the present invention provides a machine for making and packaging articles containing infusion product, the machine being of the type defined by a production line comprising a plurality of operating stations located one after the other and designed to make at least one continuous strip by superposing and sealing two webs of filter paper with measured quantities or charges of infusion product interposed between them at regular intervals; and at least one cutting station for dividing up the strip to form a succession of individual articles; the machine being characterised in that it further comprises at least one built-in packaging station for packaging groups of the articles in bag-like packets; the built-in packaging station being located immediately downstream of the cutting station and comprising a packaging device for making up stacks with the articles and a transfer device which guides the stacks of articles along a vertical feed path section transversal to the production line and feeds them into the bag-like packets.

DESCRIPTION OF THE DRAWINGS

The technical characteristics of the invention, with reference to the above aims, are clearly described in the claims below and its advantages are apparent from the detailed description which follows, with reference to the accompanying drawings which illustrate a preferred embodiment of the invention provided merely by way of example without restricting the scope of the inventive concept, and in which:

DETAILED DESCRIPTION OF THE PREFERRED EMBODIMENTS OF THE INVENTION

Figure 1:
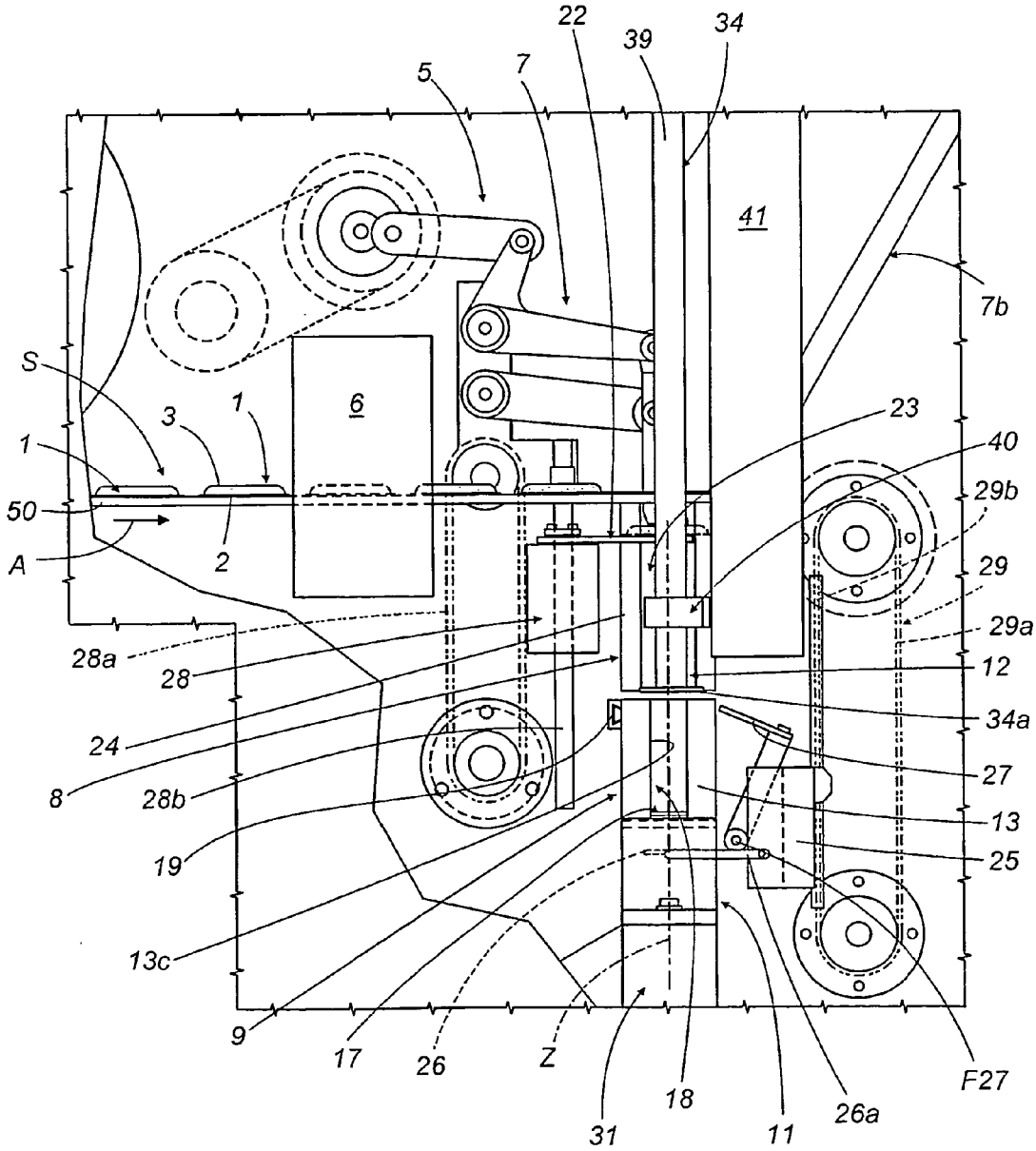
FIG. 1 is a front view, partly in cross section and with some parts cut away for clarity, of a built-in packaging unit constituting an integral portion of a machine for making articles containing infusion product, in particular filter paper pods.
Figure 2:
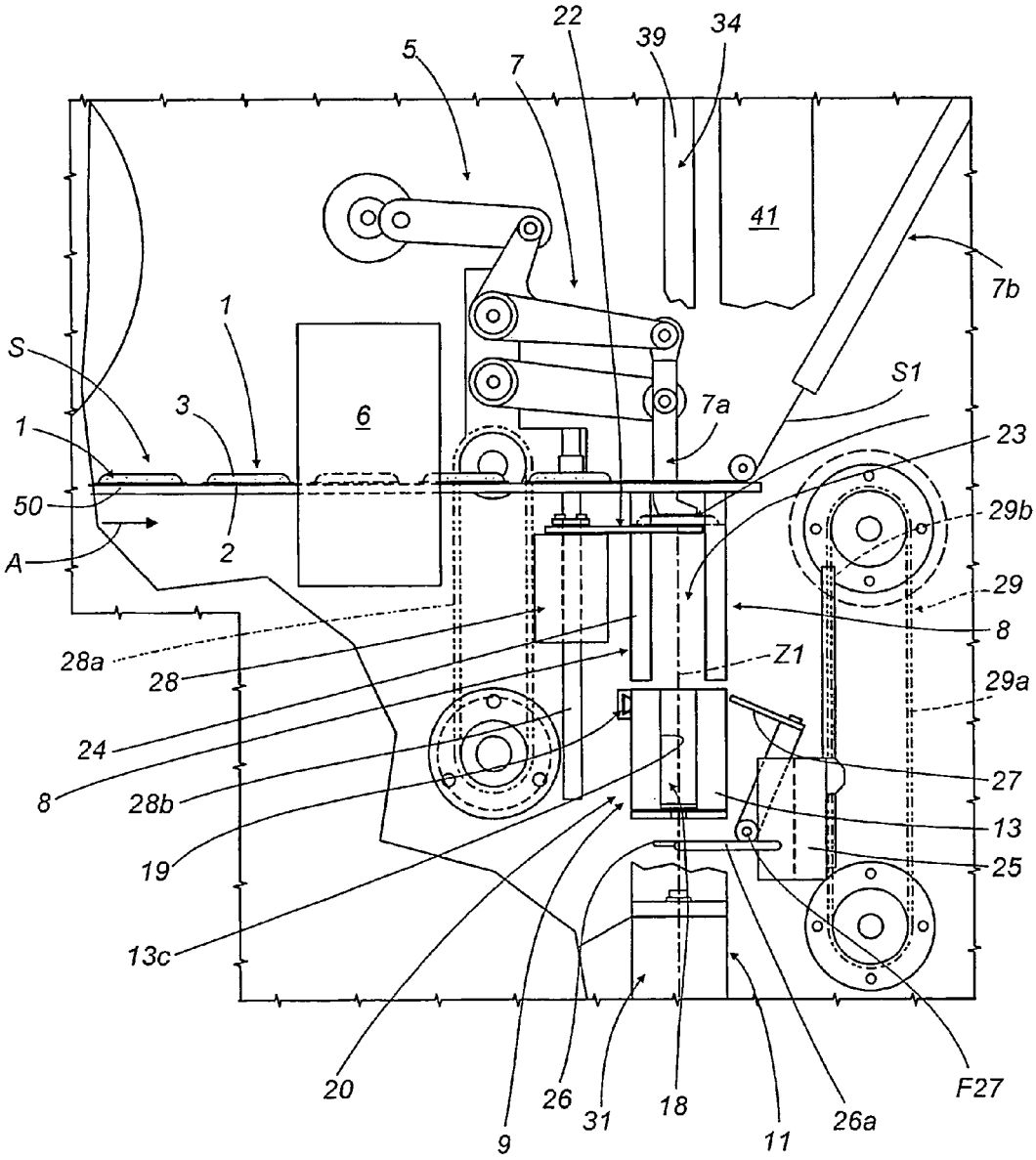
FIG. 2 illustrates a detail of the machine portion of FIG. 1, again in a front view.
Figure 3:
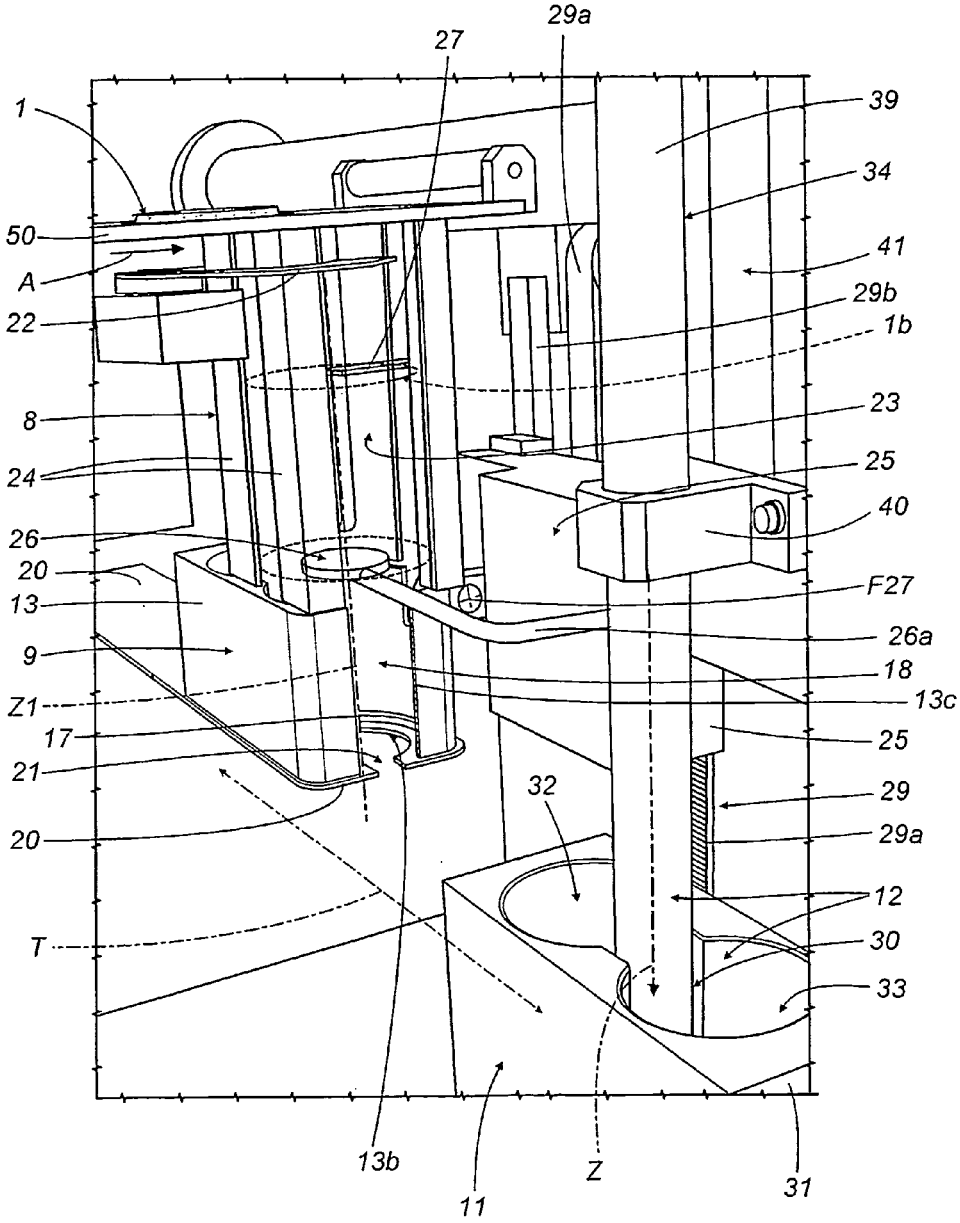
FIG. 3 is a perspective view of the machine portion illustrated in FIGS. 1 and 2.
Figure 4:
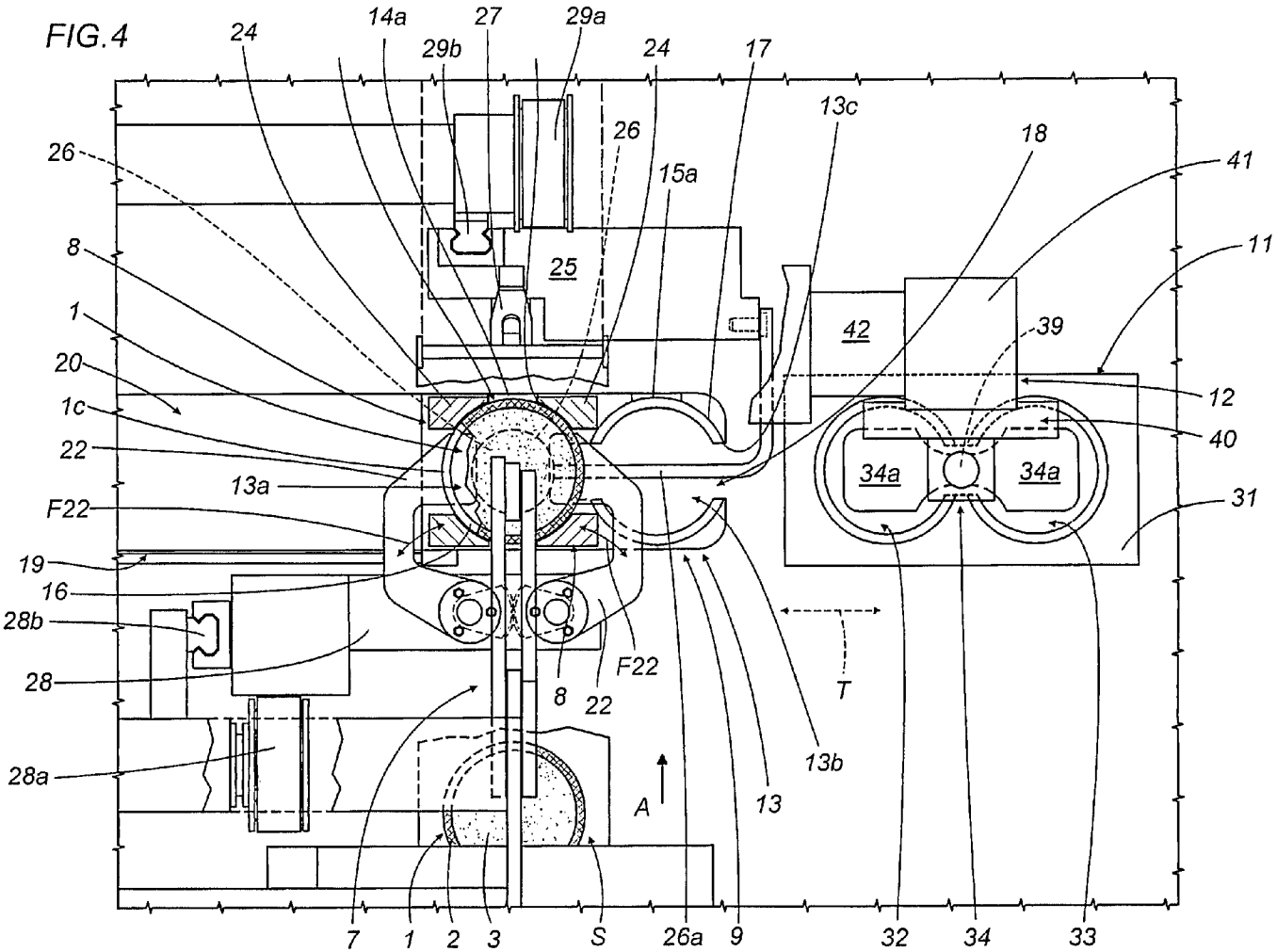
FIG. 4 is a top plan view of the machine portion illustrated in FIGS. 1 to 3.
Figure 5:
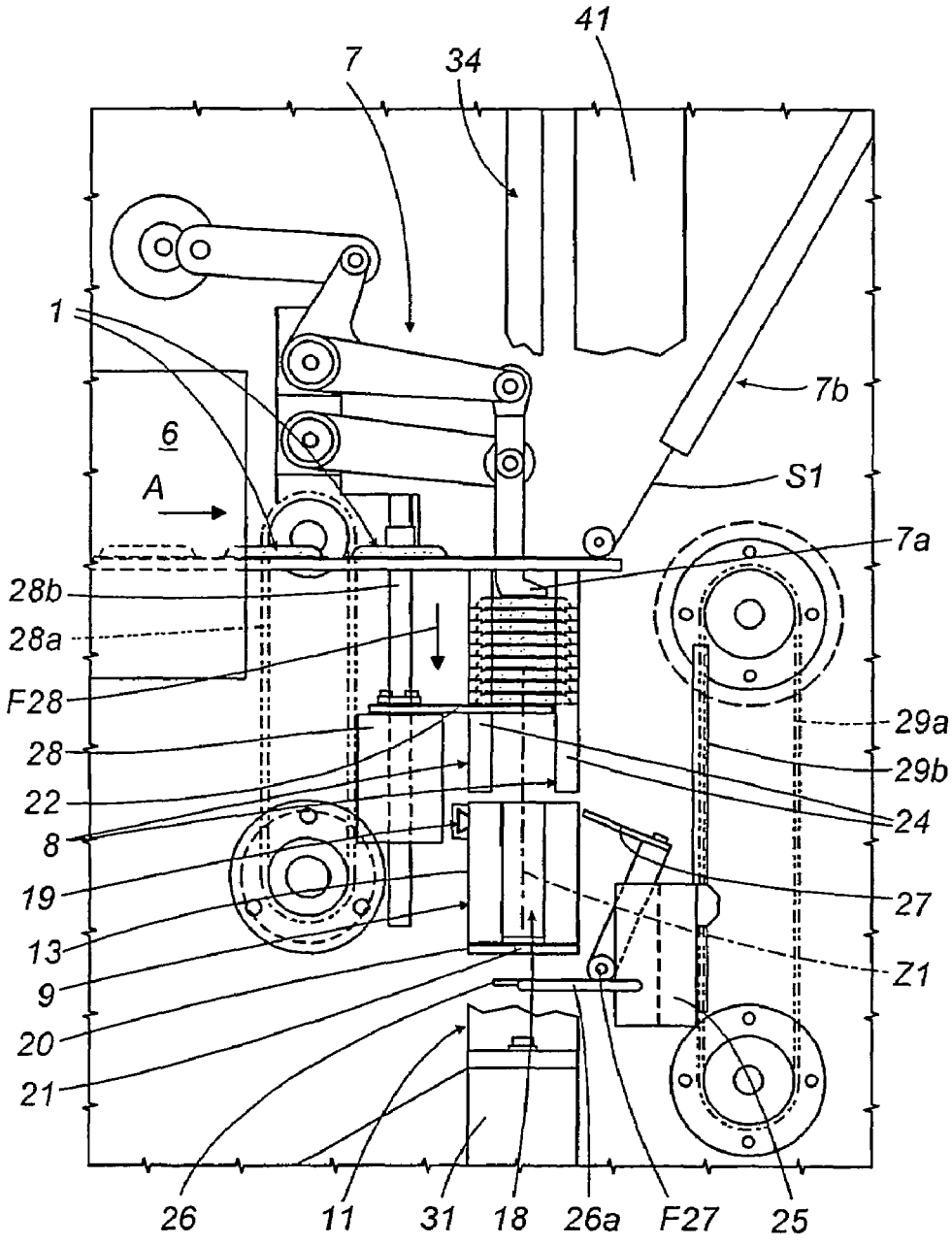
FIGS. 5 to 10 are front views illustrating the movement and steps of an operating station for stacking, placing and moving the articles on the built-in machine portion shown in FIGS. 1 to 5.
Figure 6:
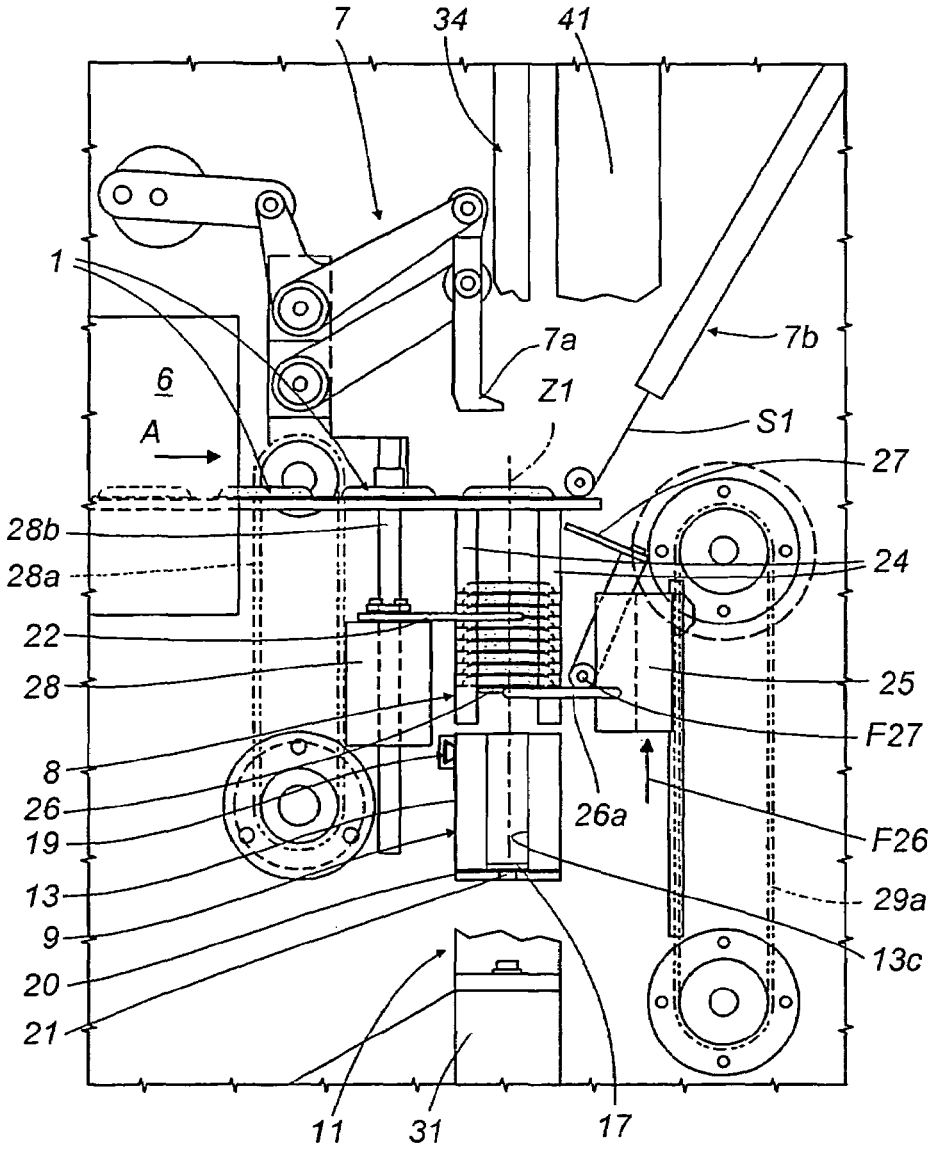
Figure 7:
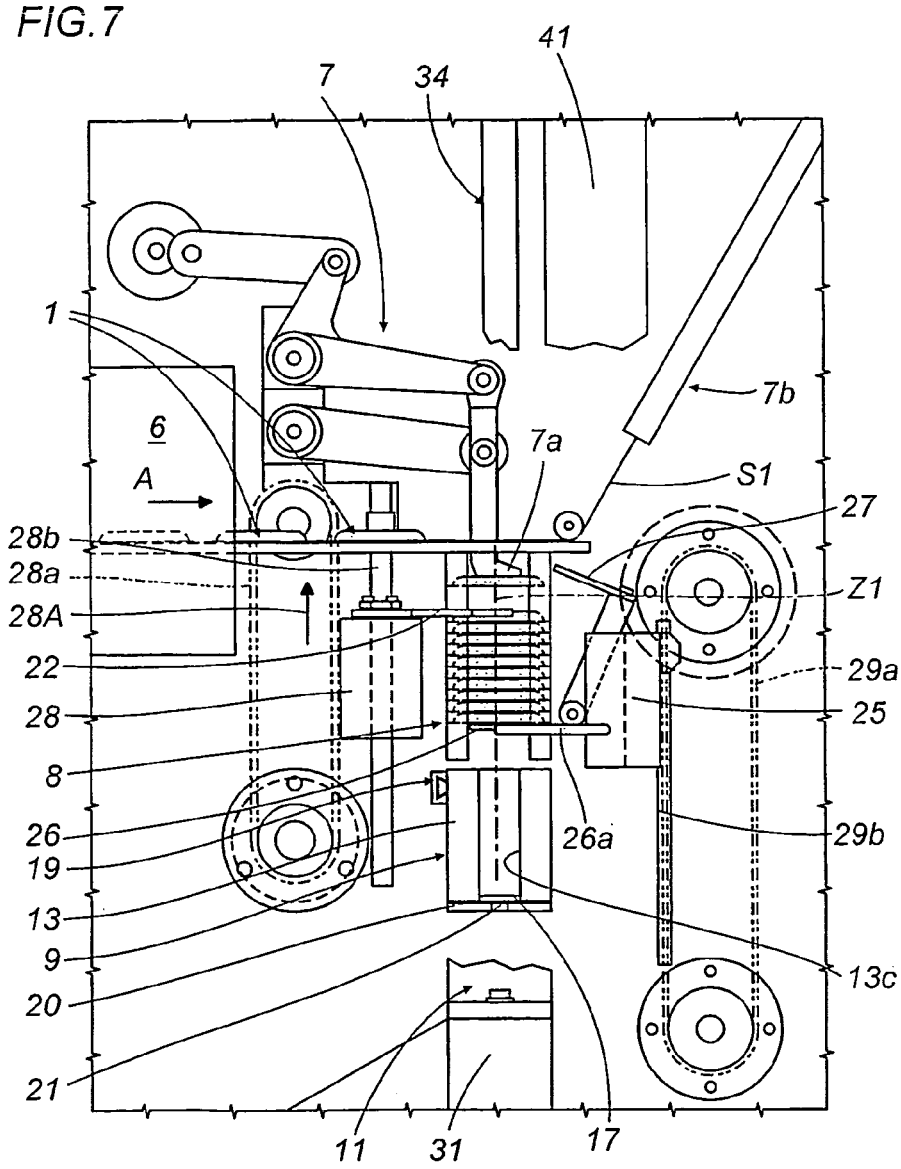

With reference to the accompanying drawings, in particular FIGS. 1 to 3, the packaging machine according to the invention is used to make and package articles, in particular pods of filter material containing a product for infusion, such as powdered coffee.

The pod 1, in this non-restricting embodiment of the invention, is of well-known type, comprising two lengths 2 and 3 of filter material placed face to face and joined to each other by sealing round the edges after a charge 4 has been placed on the surface of only one of the lengths to form the pod 1.

The pod making machine, labelled 5 as a whole in FIGS. 1 and 2, comprises a plurality of operating stations located in succession along a production line A extending in a substantially horizontal direction. More specifically, the machine 5 comprises: a plurality of operating stations for arranging the pods 1 in their final configuration, consisting of at least one continuous strip S obtained by superposing two webs of filter material with charges 4 of infusion product interposed between them at regular intervals; an operating station 6 where the two superposed webs are sealed to each other to form the strip S, and where the strip S itself is subsequently cut at least in the area surrounding each charge 4 to make individual pods 1; and a station 7 for separating the individual pods 1 from waste material or trimmings S1 of the strip S itself.

In the description that follows, the operating stations for making the pods 1 are not described specifically since they do not strictly fall within the scope of the invention which, as will be seen in more detail in the rest of this specification, relates in particular to the end portion of the machine where the pods 1 are packed in bag-like packets 10.

As shown in FIGS. 1 and 2, the separating station 7 comprises a pusher element 7*a* located downstream of the cutting station 6 and designed to push the individual pods 1 vertically under the feed table 50 towards a packaging station 8 built into the machine 5 and described in greater detail below.

The separating station 7 also comprises a unit 7*b* for expelling the waste trimmings S1 downstream of the pusher 7*a* with respect to the production line A.

As mentioned above, in addition to the production operating stations, the machine 5 has a built-in packaging station 8, located immediately downstream of the station 6 and preferably but not necessarily under the separating station 7, and comprises a stacking device 9 for making up stacks (labelled 1*a*, 1*b* in FIGS. 5 to 9) of pods 1 in the quantity to be packaged in a respective bag-like packet 10, and for moving the stacks 1*a*, 1*b* to a transfer device 11 which comprises means 12 for the guiding and controlled downfeed of the stacked pods 1 along a vertical feed path section Z and into a bag-like packet 10; the packet 10 being located at the bottom end of the guide and controlled downfeed means 12 themselves.

As clearly shown in FIG. 3, the straight vertical feed path section Z of the pods 1 is transversal to the direction of the production line A and parallel to a stacking axis Z1 of the pods 1 at the packaging station 8.

Looking more closely at the technical details, starting from the packaging station 8 in order to better understand how the stacks 1*a*, 1*b* of pods 1 are formed and the feed path they follow, the station 8 comprises the following (FIGS. 1 to 4): a pair of vertically sliding, pre-stacking levers 22 designed to retain a predetermined number of pods 1 fed by the above mentioned separating station 7 and operating at a vertical stacking channel 23 defined by four vertical guides 24; a second carriage 25, which moves vertically, interacting with the pair of levers 22, and which has a base plate 26 and an upper retaining fork 27 acting in the stacking channel 23 to receive the predetermined number of stacked pods 1 from the pair of levers 22 and to complete a stack 1*a*, 1*b* of pods 1 in such a way as to place the stack 1*a*, 1*b* of pods 1 in the device 9.

More specifically, with reference to FIGS. 1 to 4, the levers 22 are positioned opposite each other on both sides of the channel 23 and are mobile between a working position in which the levers 22 are close together (continuous line in FIG. 4) and engage the channel 23 in such a way a way as to support the pods 1 in the channel 23, and an idle position (arrows F22 and broken line in FIG. 4) in which the levers 22 are apart in such a way as to enable the pods 1 to move down rapidly towards the plate 26.

The pair of levers 22 is linked to a third carriage 28 driven by a kinematic system with belt 28*a* and guide 28*b*, and mobile vertically in step with the separating station 7 in such a way as to enable the levers 22 to move downwards gradually when they are in the working position and to move up rapidly when they are in the idle position (as explained in more detail below).

The above mentioned second carriage 25, driven vertically by a similar kinematic system (that is, comprising means 29 consisting of a belt 29*a* and a guide 29*b*), faces the pair of levers 22 on the opposite side of the channel 23.

The plate 26 that supports the pods 1 is located at the bottom end of the carriage 25 and is associated with the free end of a C-shaped supporting pin 26*a* protruding laterally from the second carriage 25 in such a way as to enable the plate 26 to be positioned at the center of the channel 23 but passing through the side of the channel 23 itself so as not to interfere with the positioning of the device 9.

Also, as stated, the retaining fork 27 of the second carriage 25 is positioned at the front of the channel 23 and can move into the channel 23 itself.

Figure 8:
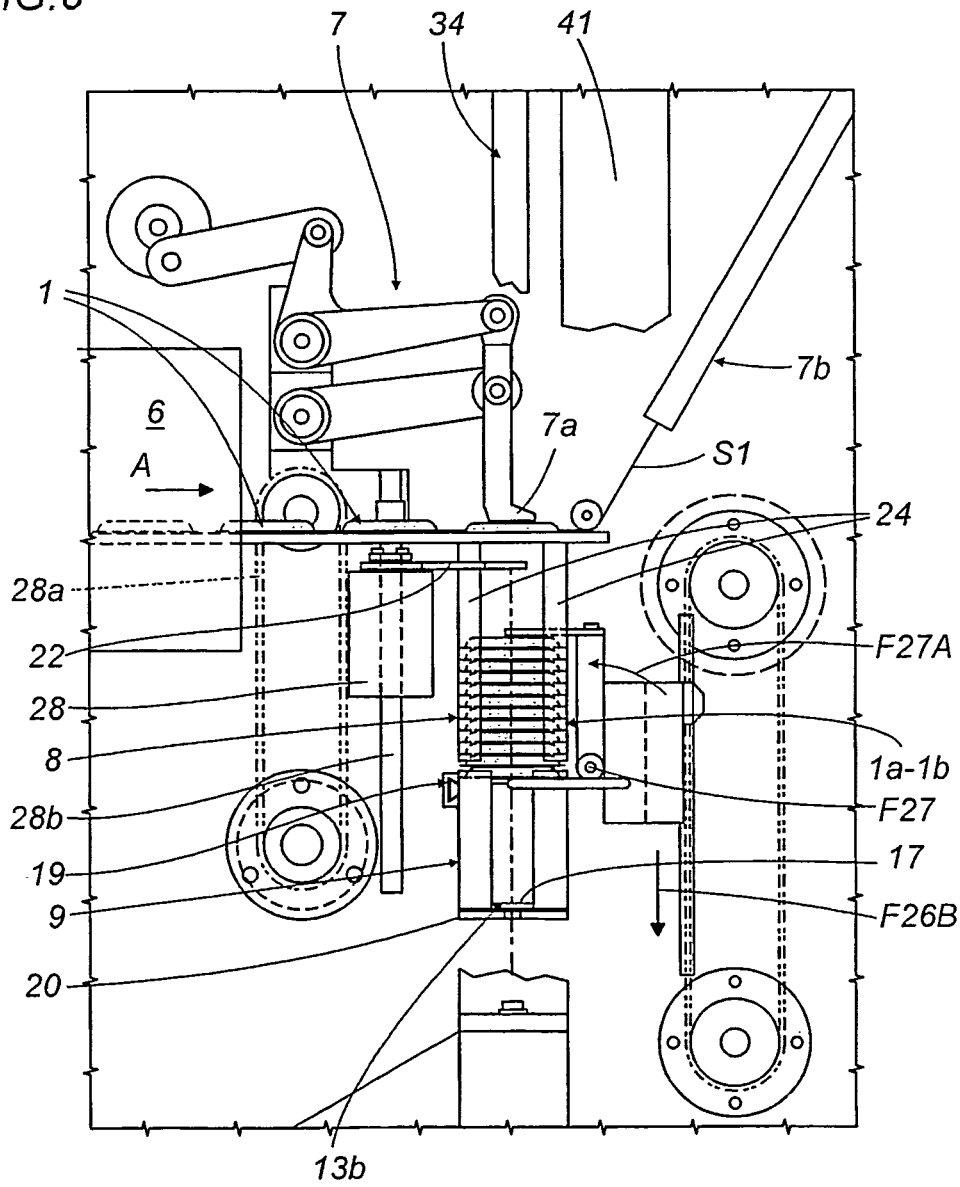

The fork 27 is pivoted to the second carriage 25 at F27 and can move between an idle position in which the fork 27 is positioned at an angle outside the channel 23 (FIGS. 1 and 2), and a working position in which the fork 27 is positioned inside the channel 23 and holds the stack 1*a*, 1*b* of pods 1 at the top pod 1 in place, at least until the pods 1 are placed in the device 9 (FIG. 8 and arrow F27A).

Figure 9:
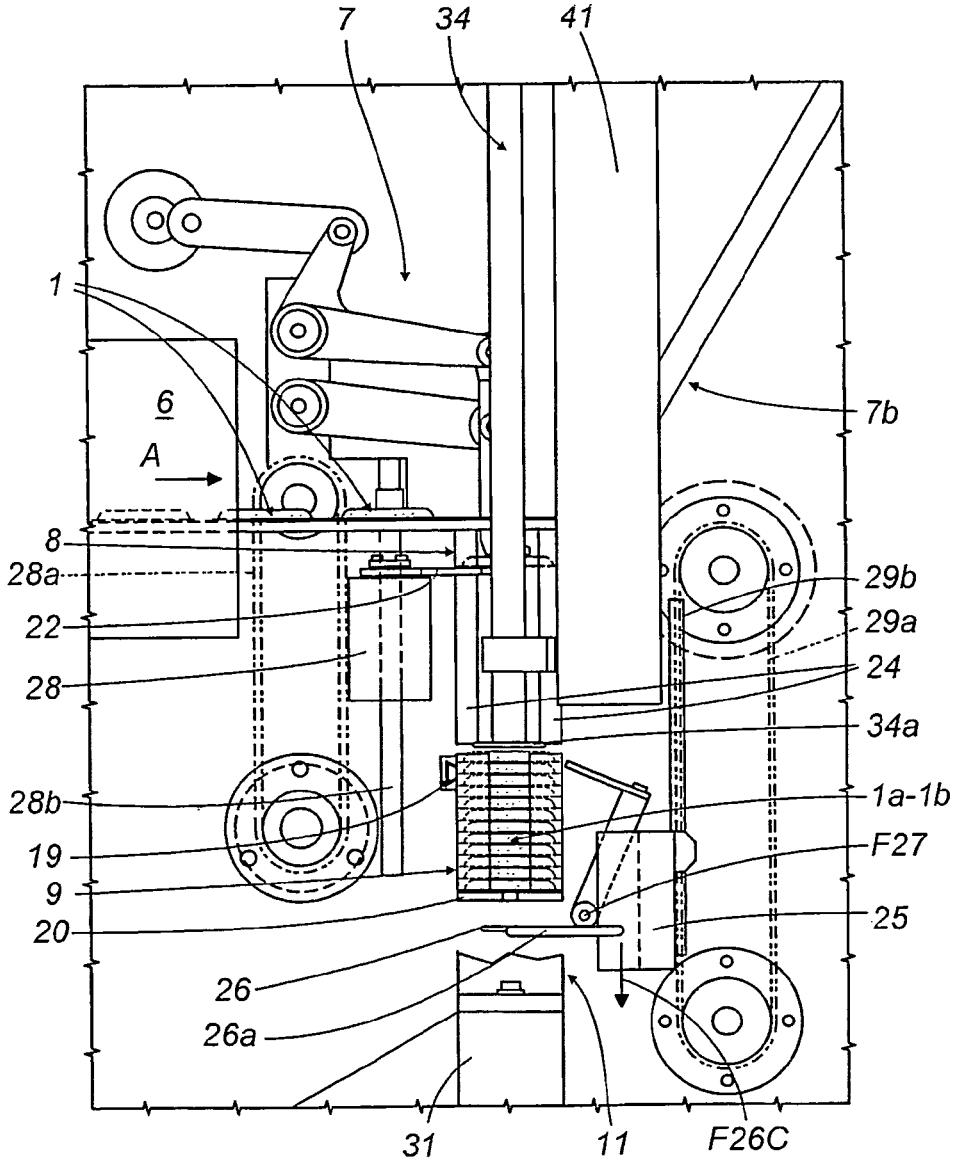
Figure 10:
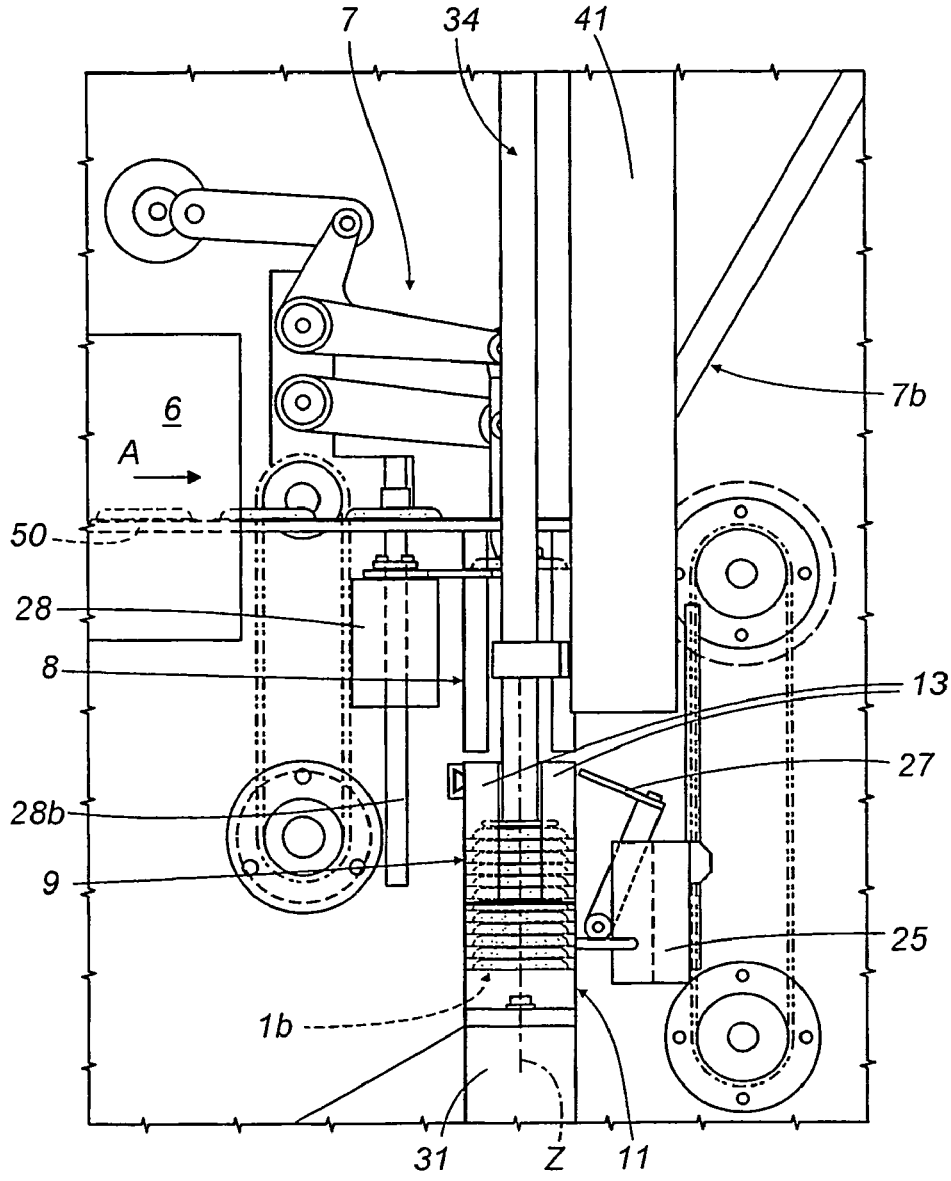
Figure 11:
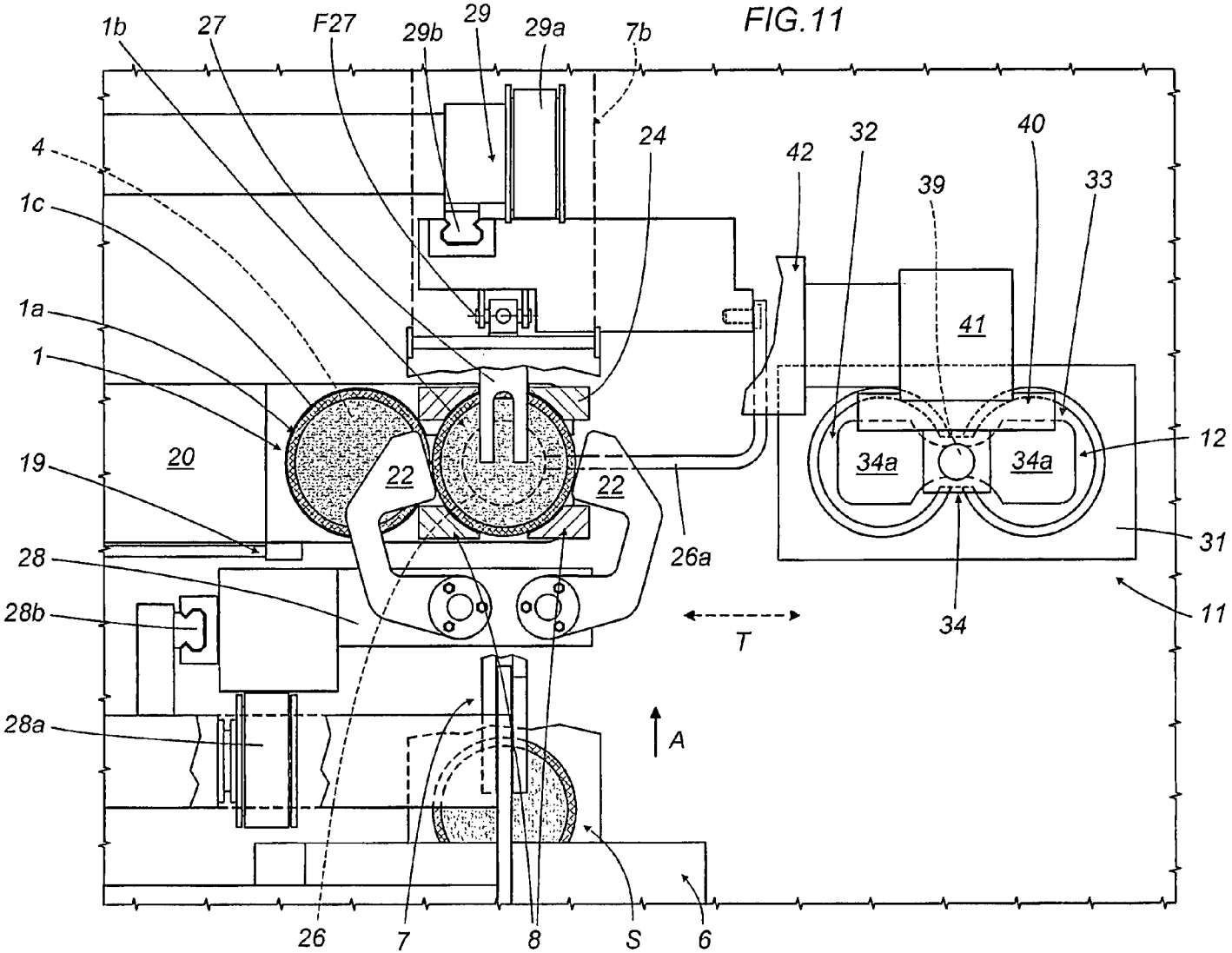
FIGS. 11 and 12 are top plan views illustrating the movements and steps of the station for packaging, placing and moving the articles shown in FIGS. 5 to 10.

The means 29 for driving the second carriage 25 are synchronised with the third carriage 28 along the stacking axis Zl so as to permit the following, respectively (FIGS. 5 to 9): stacking of a first group or partial quantity of pods 1 on the pair of levers 22 as the latter are being moved down vertically in the working position (arrow F28, FIG. 5); lifting the plate 26 to position it under the pair of levers 22 when the first partial quantity of pods 1 is stacked (arrow F26, FIG. 6); resting the pods 1 on the plate 26, with the pair of levers 22 in the idle position, and then moving the pair levers 22 up again (FIG. 7, arrow F28A); completing the stack of pods 1 in the predetermined quantity on the plate 26 as the latter moves down and the fork 27 moves to the working position on the topmost pod 1 of the stack (FIG. 8, arrow F26B); placing the stack 1*a*, 1*b* of pods 1 in the device 9 and lowering the second carriage 25 (FIG. 9, arrow F26C).

As illustrated in FIGS. 1 to 9, under the packaging station 8 there is a fixed, rigid table 20 located below the positioning area of the base of the device 9 and forming a temporary base to support the device 9 itself. The table 20 has, at the free end, a through opening 21 shaped to match, and allowing the passage of, the base plate 26 and the part of the pin 26*a* that passes through the channel 23, thereby enabling them to move down past the bottom of the channel 23 itself.

As shown in FIGS. 1 to 12, the device 9 comprises a carriage-like bucket 13 that moves between the packaging station 8 and the transfer device 11.

More specifically, but without restricting the scope of the solution offered by the invention, the carriage-like bucket 13 has at least two adjacent seats 14 and 15 for accommodating two stacks 1*a* and 1*b* of pods 1.

Each of the seats 14 and 15 has an open bottom 13*a* and 13*b* bounded by a circular ledge 16 and 17 on which the lowermost pod 1 of the respective stack 1*a* and 1*b* can be rested.

Figure 20:
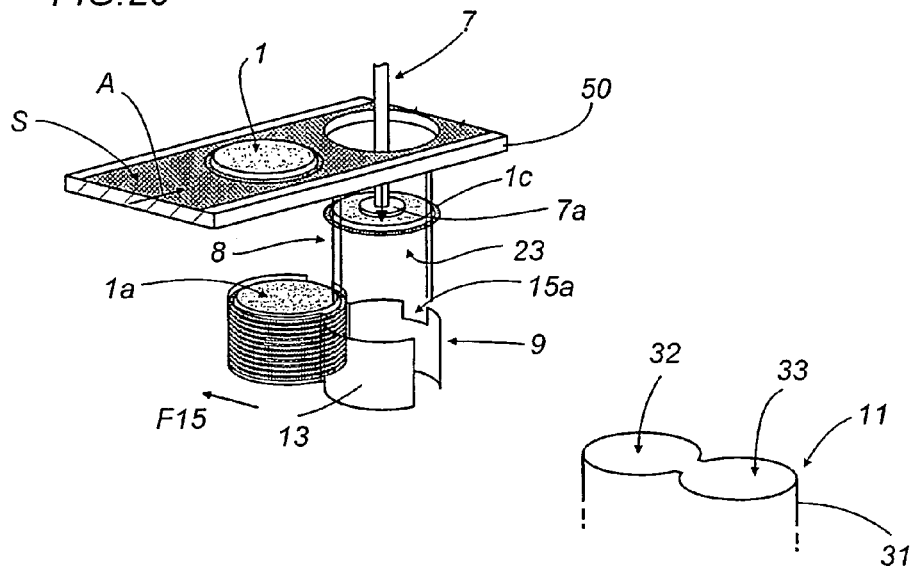
Figure 21:
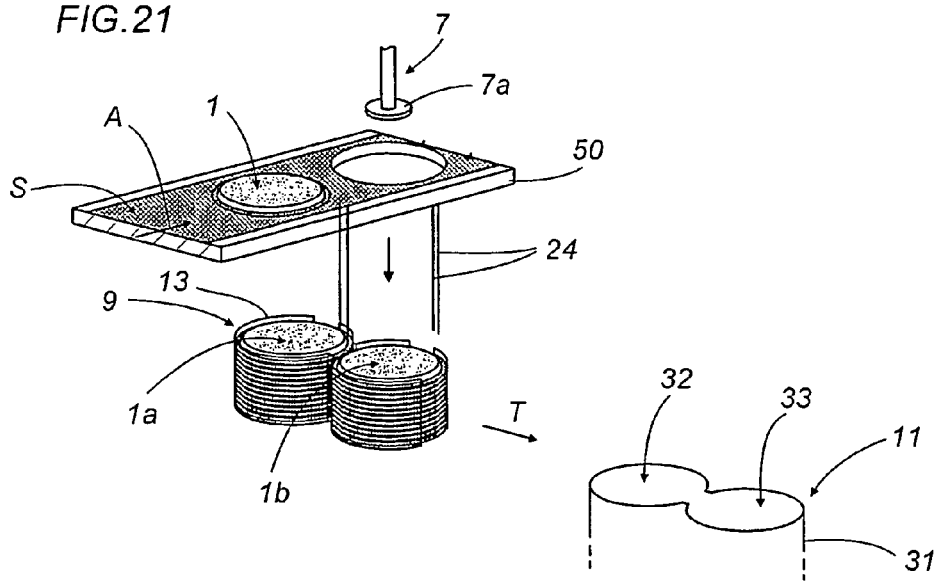
Figure 22:
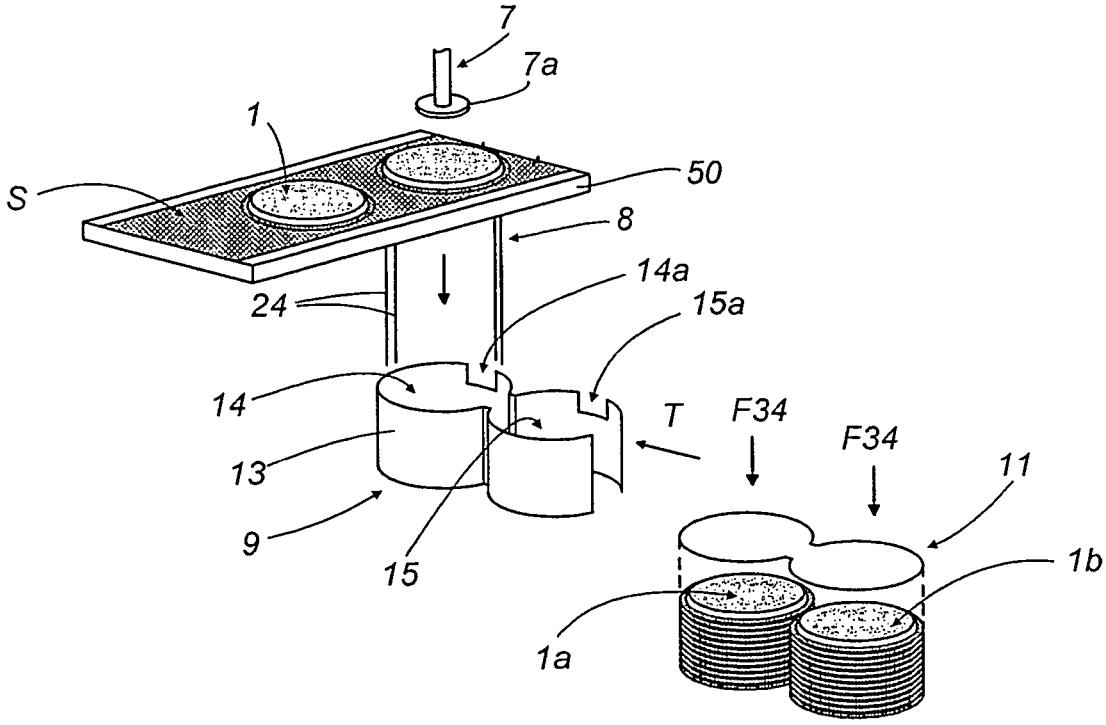

In the embodiment illustrated in FIGS. 20 to 22, the two seats 14 and 15 in the carriage-like bucket 13 form, in cross section, a binocular-shaped profile open in the middle where the two seats 14 and 15 meet and extending for the full height of the carriage-like bucket 13.

Further, the carriage-like bucket 13 has a head end 13*c* with a through vertical opening 18 extending for the full height of the bucket 13 itself: thus, the pin 26*a* that mounts the plate 26 and part of the above mentioned guide and controlled downfeed means 12 of the device 11 does not interfere with the movement of the carriage-like bucket 13, as explained in more detail below.

Another feature of the carriage-like bucket 13 is illustrated schematically in FIGS. 18 to 26: each seat 14 and 15 has a respective slot 14*a* and 15*a* at the top of it in order to enable the fork 27 to remain on the topmost pod 1 until the entire stack 1*a*, 1*b* of pods 1 has been placed in the respective seat 14, 15.

Actuating means 19 are provided for moving the carriage-like bucket 13 in both directions along a path T transversal to the axis Z or pod 1 vertical downfeed path and to the pod 1 stacking axis Z1 (FIGS. 11 and 12), so as to position the bucket 13 alternately at the packaging station 8 and at the top end of the device 11.

In the embodiment illustrated, these actuating means consist of a rigid rod 19 attached to a rear end of the carriage-like bucket 13 and slidably driven along the transversal path T by customary drive means which are not illustrated.

The actuating means 19 define two distinct locations in which first the seat 14 is in a receiving position under the packaging station 8 and then, by retracting the carriage-like bucket 13 (arrow F15, FIGS. 19 and 20), the other seat 15 is in a receiving position under the same packaging station 8.

In practice, as may be clearly observed in FIGS. 18 to 21, the two seats 14 and 15 are positioned under the channel 23 in two distinct steps and as soon as the second seat has been filled, they are moved transversally along the path T to the device 11 where the guided downfeed of the stacks 1*a* and 1*b* can take place (FIG. 22).

In an alternative embodiment illustrated in FIGS. 23 to 26, there are two stations 8, 8*a* for simultaneously packaging adjacent, parallel incoming strips S and S' of pods 1.

In this case, the device 9 is again defined by the carriage-like bucket 13 and is equipped with actuating means 19 for positioning the carriage-like bucket 13 alternately at the packaging stations 8 and 8*a* and at the top end of the device 11.

Figure 23:
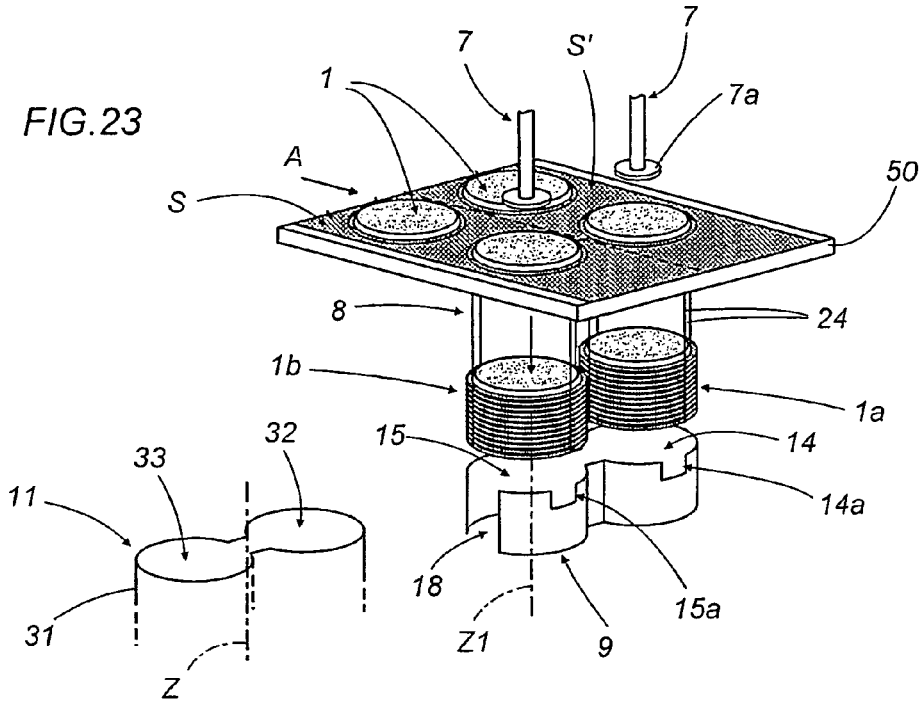
FIGS. 23 to 26 are schematic perspective views illustrating another embodiment of the succession of steps of stacking and moving the articles and releasing them in guided manner performed by the machine according to the invention.
Figure 24:
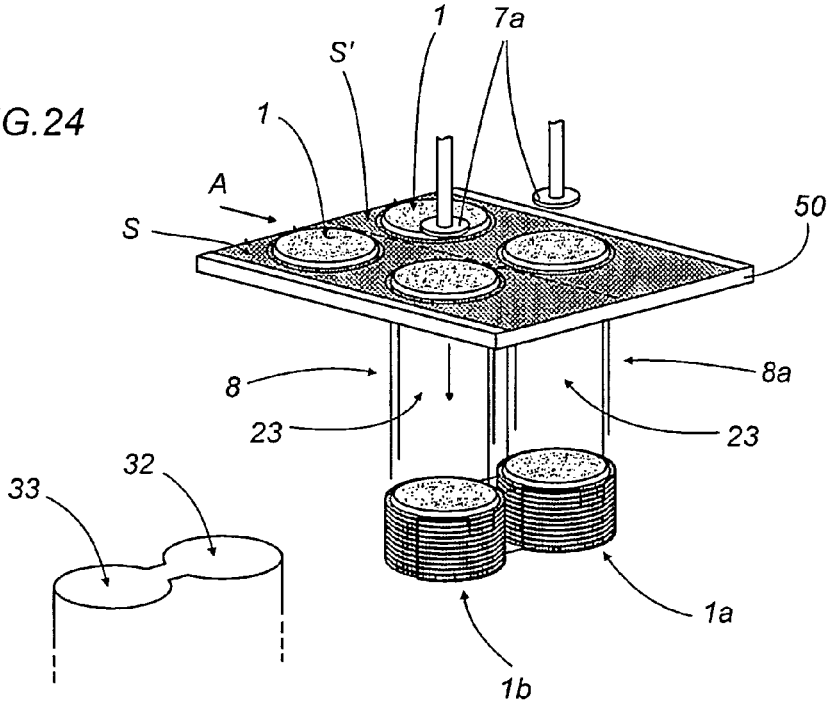
Figure 25:
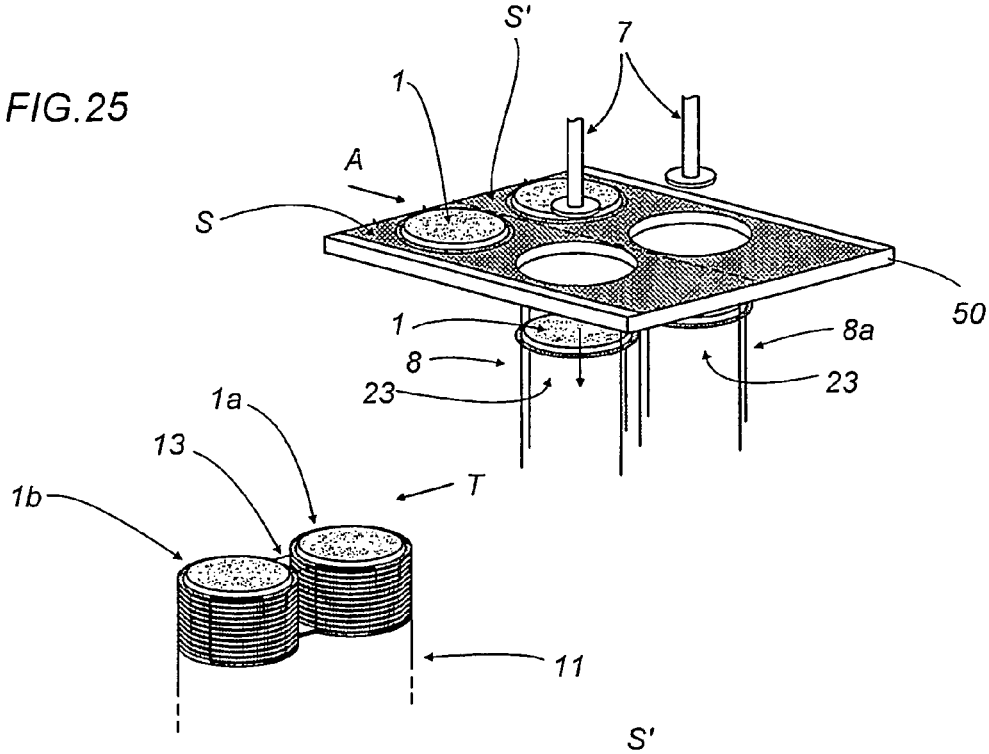
Figure 26:
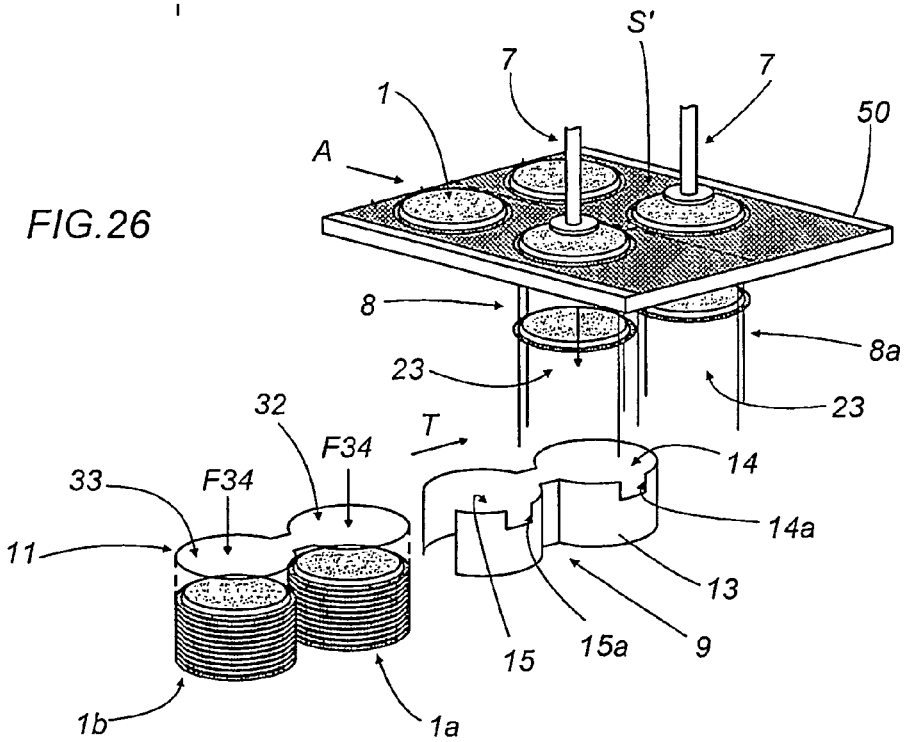

Obviously, as clearly shown in FIGS. 23 and 24, the actuating means 19 move the seats 14 and 15 to the receiving position under the respective packaging stations 8 and 8*a* in a single step.

Figure 12:
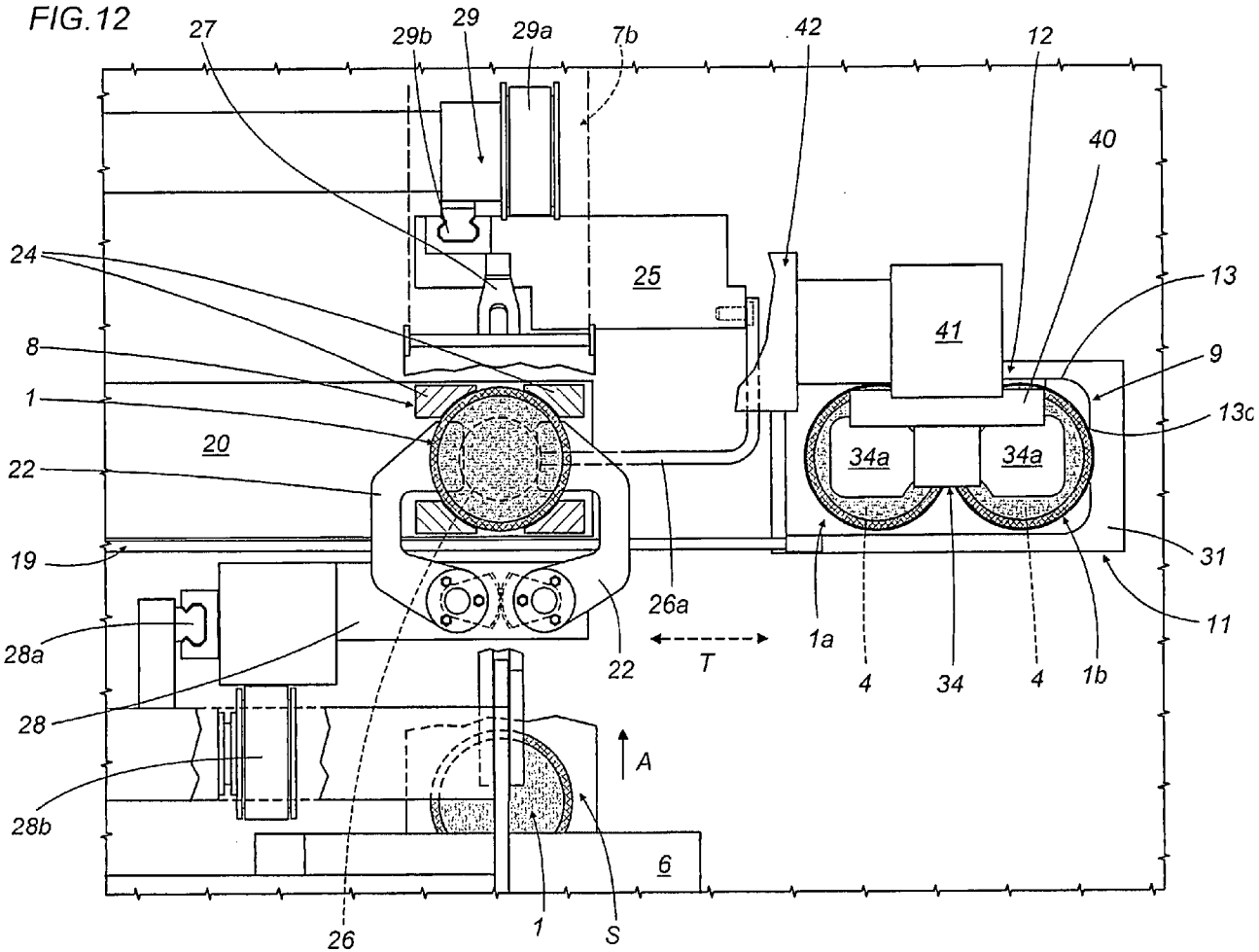
Figure 13:
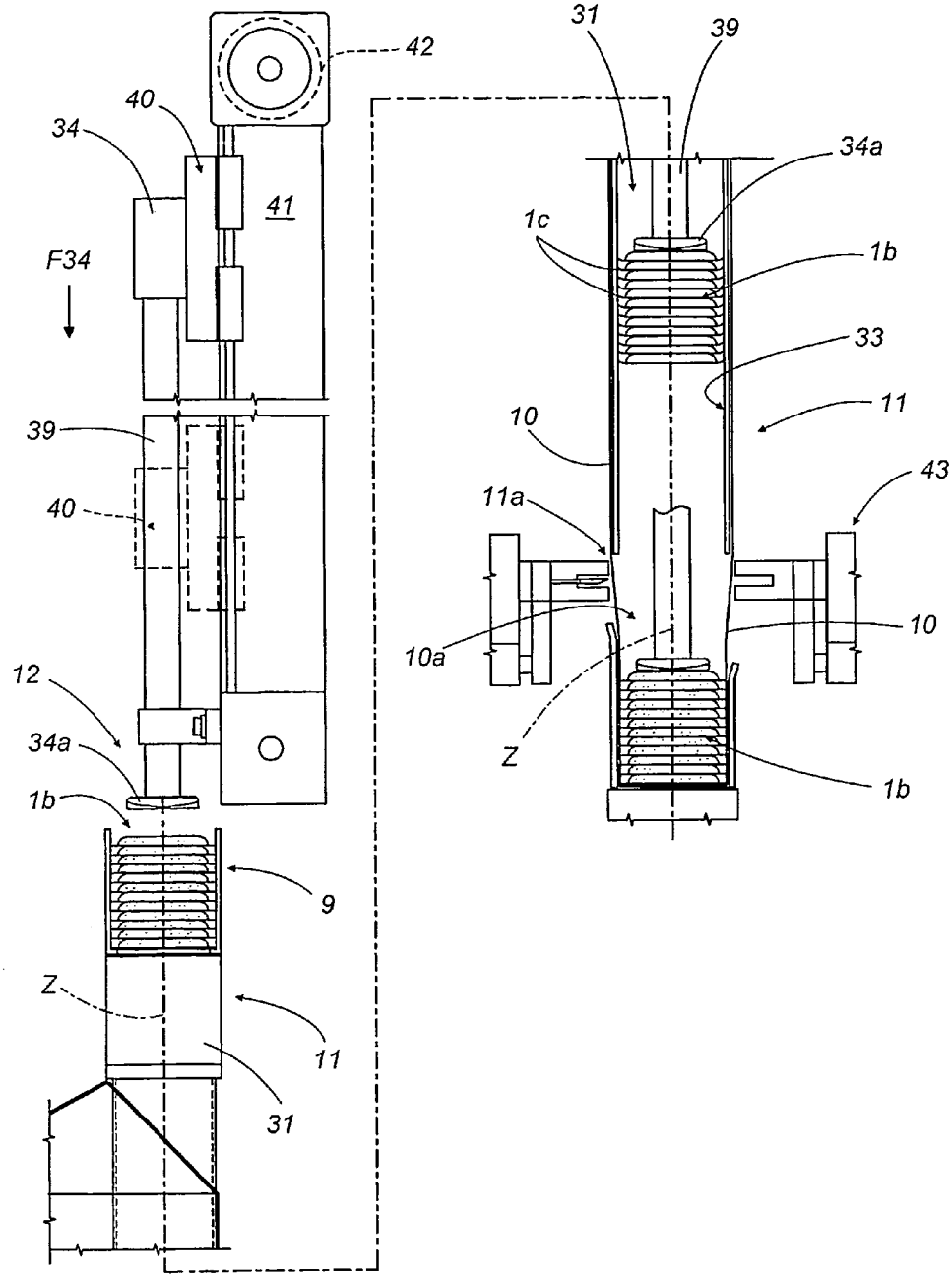
FIG. 13 is a schematic front view, partly in cross section and with some parts cut away to better illustrate others, of a unit, forming part of the machine according to the invention, for the controlled and guided downfeed of stacks of the articles.

As illustrated in FIGS. 10 to 16, the transfer device 11, besides permitting the guided downfeed of the stacks 1*a*, 1*b* of pods 1, also constitutes a supporting unit for the formation of the packet 10 which is positioned with its inlet opening 10*a* at the lower end 11*a* of the device 11 itself (as illustrated in particular in FIG. 13).

The operating units making up the station that forms the packet 10 are not illustrated in detail as they are well within the knowledge of an expert in the trade and do not strictly fall within the scope of this invention.

More specifically, the guide and controlled downfeed means 12 forming part of the device 11 comprise: a vertical channel 30 formed by a hollow element 31 located beside the packaging station 8; the inside section of the channel 30 is shaped to match and can be superposed over the section of the device 9, that is to say, it has at least one zone 32 and 33 for the passage of pods 1; an element 34 for pushing/accompanying the stacks 1*a* and 1*b* of pods 1, which is positioned above the hollow element 31 and which is vertically mobile between an idle end position where the element 34 is away from the opening at the top of the hollow element 31 (FIG. 9 and top of FIG. 13), so as to enable the carriage-like bucket 13 to be positioned at said top opening, and a working end 4 position where the element 34 guides and pushes the stacks 1*a*, 1*b* of pods 1, sliding along the inside of the channel 30 so as to position the stacks 1*a*, 1*b* of pods 1 in the bag-like packet 10 (FIG. 10, end of FIG. 13 and arrow F34). 4

To match the structure of the carriage-like bucket 13 described above, the hollow element 31 has a channel 30 whose profile can be superposed over the carriage-like bucket 13 itself, that is to say, its cross-sectional profile has a binocular-like shape defining two adjacent circular zones 32 and 33 in order to permit simultaneous guided downfeed of two side-by-side stacks 1*a* and 1*b* of pods 1 (FIGS. 3, 4, 11, 12 and 16).

Figure 16:
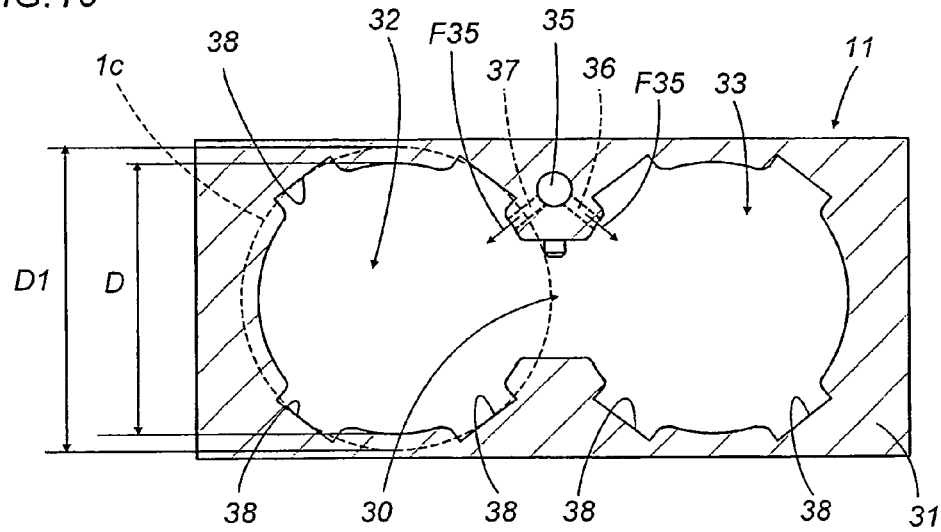
FIG. 16 is a cross section through a horizontal plane of a part of the controlled downfeed unit, that is, a hollow element.

As illustrated in FIG. 16, the two circular zones 32 and 33 of the channel 31 for access by the pod 1 stacks 1*a* and 1*b* have a diameter D that is smaller than the diameter D1 of the pods 1 so that the pods 1 rub against the sides of, and are thus guided by, the channel 31 as they are pushed down along it. obviously, to be able to correctly control downfeed in this way, the diameter D of the zones 32 and 33 is just a little smaller than the diameter D1 of the pods 1, taking into account the outer ring 1*c* of the pod 1 formed by the superposed webs of filter paper which are flexible and easily deformed when the stacks 1*a* and 1*b* are pushed into the channel 30.

Figure 17:
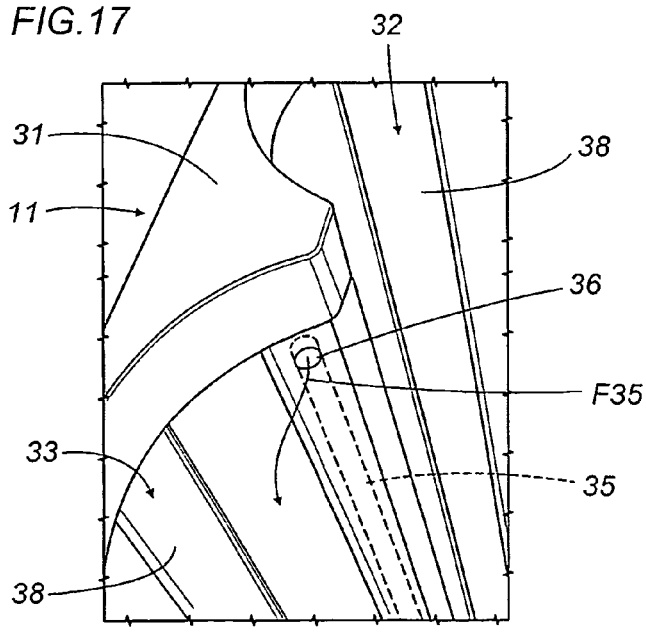
FIG. 17 is a perspective view of a detail of the hollow element of FIG. 16.
Figure 18:
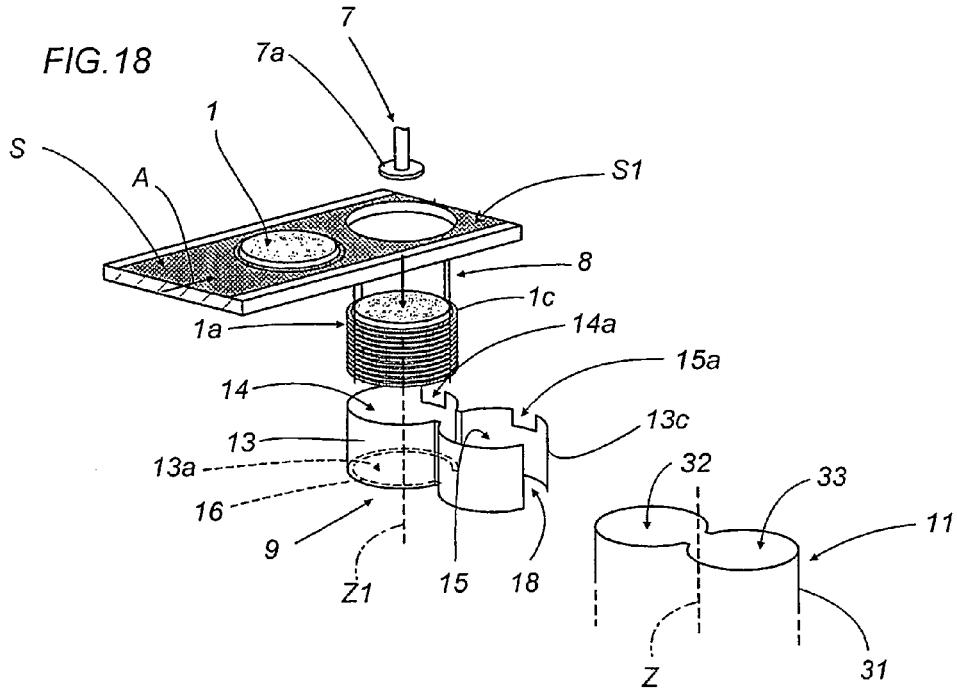
FIGS. 18 to 22 are schematic perspective views illustrating a succession of steps of stacking and moving the articles and releasing them in guided manner performed by the machine according to the invention.
Figure 19:
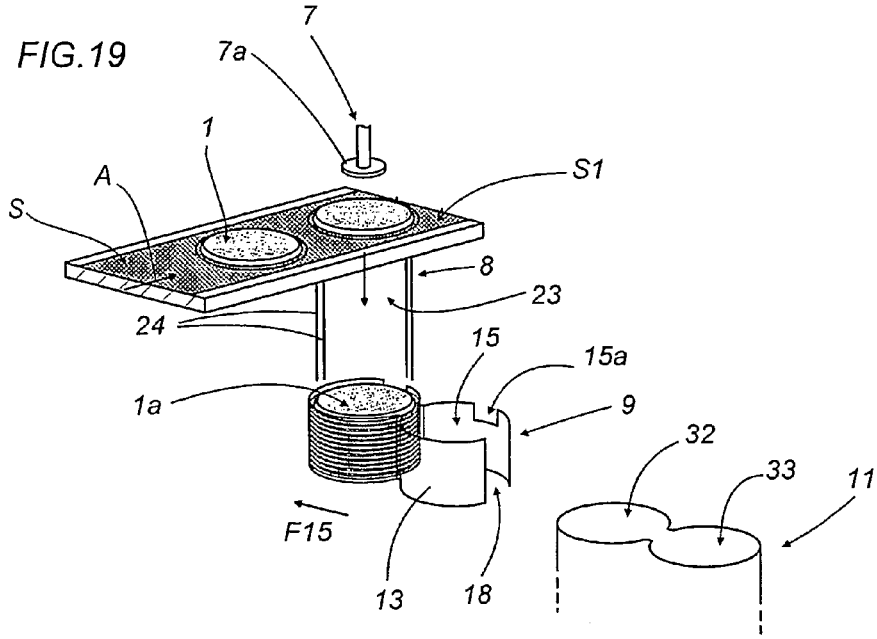

As illustrated in FIGS. 16 and 17, the hollow element 31 is equipped with a longitudinal conduit 35 for conveying an inert fluid (for example, nitrogen) positioned centrally between the two circular zones 32 and 33, and leading into at least one bottom opening 36 through which the fluid itself is fed into the hollow element 31: thus, the inert fluid is blown onto the pods 1 as to prevent damage to the pods 1 as they move down into the packet 10 (arrows F35).

For better and more even distribution of the fluid, the longitudinal conduit 35 leads into at least two opposite openings 36 and 37, one for each of the circular zones 32 and 33. More specifically, the fluid flow is directed from the bottom up in the channel 30.

Further, each of the circular zones 32 and 33 has radial grooves 38 around its circumference, said grooves 38 extending for the full length of the circular zones 32 and 33 to enable air to escape in the direction opposite the downward direction of motion of the stacks 1*a*, 1*b* towards the packet 10.

The aforementioned pushing/accompanying element 34 comprises a flat head 34*a* designed to come into contact with the pods 1 so as to push and guide the pods down the circular zones 32 and 33. The head 34*a* is preferably two-lobed to allow two stacks 1*a* and 1*b* of pods 1 to be pushed simultaneously (FIG. 12).

The head 34*a* is also associated with a vertical rod 39 that slides along guides 40 associated with a vertical column 41 located above the hollow element 31.

The rod 39 is preferably driven by a variable-speed motor 42 (for example, a brushless motor) positioned at the top end of the column 41 which moves it between the aforementioned idle and working positions.

Figure 14:
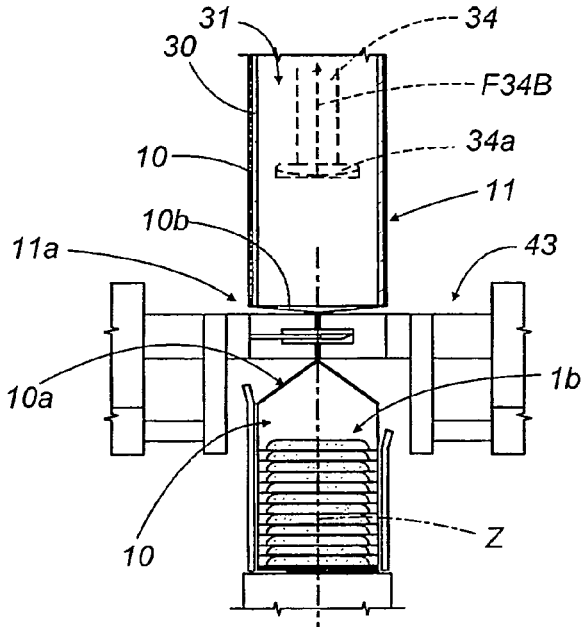
FIG. 14 is a front view of a bottom area of the downfeed unit of FIG. 13, showing an operating unit, in a working position, for sealing and cutting bag-like packets, and an area for housing the packets being filled and sealed.
Figure 15:
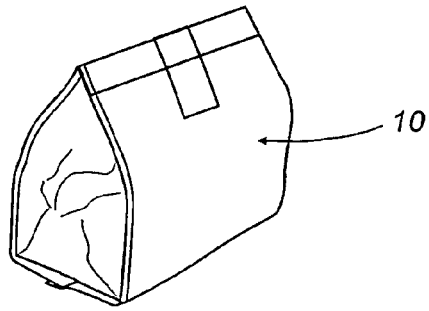
FIG. 15 is a side perspective view of a finished bag-like packet made by the machine according to the invention.

At the lower end of the hollow element 31, there is a sealing and cutting unit 43 (forming part of the above mentioned station that forms the packet 10) designed to close the inlet opening 10*a* of the bag-like packet 10 positioned under the hollow element 31 and to simultaneously form the base 10*b* of the next packet 10 being formed around the hollow element 31 (see FIG. 14).

The following is a brief description of the steps in the process by which the parts described above place the pods 1 in their final packaging: stacking of a first predetermined number of pods 1 in the vertical channel 23 (FIG. 18); placing the first stack 1*a* thus formed in the seat 14 of the carriage-like bucket 13 positioned beneath it (FIG. 19); stacking of a second predetermined number of pods 1 in the vertical channel 23 and simultaneously retracting the carriage-like bucket 13 (FIG. 20) to move the next seat 15 into position; placing the second stack 1*b* thus formed in the seat 15 of the carriage-like bucket 13 (FIG. 21) to define the final quantity and configuration to be placed in the packet 10; transferring the carriage-like bucket 13 along the path T and guiding the pair of stacks 1*a* and 1*b* down the vertical channel 30 until the stacks 1*a* and 1*b* are fully inside the bag-like packet 10 (FIGS. 22 and 13); returning the carriage-like bucket 13 to the channel 23 as soon as the pushing/accompanying element 34 starts pushing the stacks 1*a* and 1*b* down, this being possible thanks to the opening 18 in the bucket's side 13*c*; lifting the pushing/accompanying element 34 (arrow F34B, FIG. 14) and finally sealing the packet 10.

In the alternative embodiment illustrated in FIGS. 23 to 26, the difference lies in that the two stacks 1*a* and 1*b* are formed simultaneously in channels 23 and 23' and placed in the seats 14 and 15 of the carriage-like bucket 13 (FIGS. 23 and 24), without positioning the latter in successive steps, whilst the steps of moving the stacks are the same as those in the embodiment described previously.

A pod making machine with built-in packaging feature as described above achieves the aforementioned aims thanks to an extremely compact and efficient structure of the stations for handling and stacking the pods.

This architecture offers numerous advantages, namely: a reduction in the space required for transit between the area where the pods are made and the area where they are packaged, making it possible to integrate the packaging station into the pod making machine; an overall reduction in the number of working parts and stations making up the packaging station, thereby lowering the production cost of the machine as a whole; the possibility of significantly increasing the packaging speed because the pod stacks are pushed down into the bag-like packets at a higher speed than can be achieved by gravity alone; high quality end packages thanks to the efficient guiding and control of pod transfers between the area where the pods are made and the area where they are finally packaged; a high degree of adaptability of the packaging station which, with just a few structural changes, can easily be adapted according to requirements to make bag-like packets of different kinds.

It will be understood that the invention as described herein can be modified and adapted in several ways without thereby departing from the scope of the inventive concept. Moreover, all the details may be substituted by technically equivalent elements.

The invention claimed is:

1. A machine for making and packaging articles containing an infusion product, the machine being defined by a production line and comprising:

a plurality of operating stations arranged in a series relative to each other and designed to make at least one continuous strip by superposing and sealing two webs of filter paper with measured quantities or charges of infusion product interposed between the two webs at regular intervals;

at least one cutting station for dividing the strip to form a succession of individual articles; and at least one built-in packaging station for packaging groups of the articles in packets, wherein the built-in packaging station is located immediately downstream of the cutting station and includes a packaging device for forming stacks of articles and a transfer device which guides the stacks of articles along a vertical feed path section in a direction that is transverse relative to the production line and feeds the stacks of articles into the packets, and wherein each packet is formed on the transfer device and positioned with an inlet opening at a lower end of the transfer device.

2. A machine for making and packaging articles containing an infusion product, the machine being defined by a production line and comprising:

a plurality of operating stations arranged in a series relative to each other and designed to make at least one continuous strip by superposing and sealing two webs of filter paper with measured quantities or charges of infusion product interposed between the two webs at regular intervals;

at least one cutting station for dividing the strip to form a succession of individual articles; and at least one built-in packaging station for packaging groups of the articles in packets, wherein the built-in packaging station is located immediately downstream of the cutting station and includes a packaging device for forming stacks of articles and a transfer device which guides the stacks of articles along a vertical feed path section in a direction that is transverse relative to the production line and feeds the stacks of articles into the packets, and wherein the packaging device includes a bucket that moves to and from the transfer device, and wherein the bucket is equipped with at least one seat for receiving at least one of the stacks of articles.

3. The machine according to claim 2, wherein the bucket has an open bottom bounded by a circular ledge on which an article forming a bottom of a corresponding stack is placed.

4. The machine according to claim 2, wherein the bucket includes a pair of adjacent seats for receiving two stacks of articles, and wherein each seat has an open bottom bounded by a circular ledge on which an article forming a bottom of a corresponding stack is placed.

5. The machine according to claim 4, wherein the pair of adjacent seats in the bucket form, in cross section, a binocular-shaped profile that is open in a middle region where the pair of adjacent seats meet and extend along an entire height of the bucket.

6. The machine according to claim 2, wherein a head end of the bucket has a vertical opening extending along an entire height of the bucket.

7. The machine according to claim 2, wherein the at least one seat in the bucket has a respective slot defined at an upper region thereof to partially accommodate at least a portion of means for stabilising and stacking the articles.

8. The machine according to claim 2, wherein the bucket is equipped with actuating means for moving the packaging device in both directions along a path transverse relative to the vertical feed path section and to an article stacking axis, and which imparts reciprocating motion to the bucket.

9. The machine according to claim 8, wherein the actuating means includes a rigid rod that is attached to a rear end of the bucket and is slidably driven along the path.

10. The machine according to claim 8, wherein the actuating means positions at least one seat of a pair of adjacent seats under the packaging station, and wherein the bucket is provided with the pair of adjacent seats.

11. The machine according to claim 2, comprising two adjacent packaging stations for simultaneously packaging the articles.

12. The machine according to claim 2, further comprising a fixed, rigid table located at a stacking area below a base of the packaging device and forming a temporary base, wherein the table has a free end with a through opening formed therein to permit passage of a base plate therethrough.

13. A machine for making and packaging articles containing an infusion product, the machine being defined by a production line and comprising:

a plurality of operating stations arranged in a series relative to each other and designed to make at least one continuous strip by superposing and sealing two webs of filter paper with measured quantities or charges of infusion product interposed between the two webs at regular intervals;

at least one cutting station for dividing the strip to form a succession of individual articles; and at least one built-in packaging station for packaging groups of the articles in packets, wherein the built-in packaging station is located immediately downstream of the cutting station and includes a packaging device for forming stacks of articles and a transfer device which guides the stacks of articles along a vertical feed path section in a direction that is transverse relative to the production line and feeds the stacks of articles into the packets, and wherein the packaging station comprises:

a pair of vertically sliding, pre-stacking levers acting at a vertical stacking channel defined by four vertical guides; and a second carriage, which moves vertically, interacting with the pair of pre-stacking levers, and which has a base plate and an upper retaining fork acting in the stacking channel to receive a predetermined number of stacked articles from the pair of pre-stacking levers and to place the stack of articles in the packaging device.

14. The machine according to claim 13, wherein each lever of the pair of pre-stacking levers is positioned opposite each other on both sides of the stacking channel and is movable between a working position in which the pre-stacking levers are close together and engage the stacking channel to support the articles in the stacking channel, and an idle position in which the stacking levers are apart to enable the articles to move down rapidly, wherein the pair of pre-stacking levers are linked to a third, power-driven carriage that is vertically movable to enable the pair of pre-stacking levers to move downward at a relatively slow rate when in the working position and to move upward at a relatively fast rate when in the idle position.

15. The machine according to claim 14, wherein the second carriage includes drive means that move in step with the third carriage along a stacking axis to permit the following steps to be performed:

stacking of a first group of articles on the pair of pre-stacking levers as the pair of pre-stacking levers are moving vertically downward in the working position;

lifting the base plate to position the base plate under the pair of pre-stacking levers when the first group of articles is stacked;

resting the articles on the base plate, when the pair of pre-stacking levers are in the idle position;

then moving the pair of pre-stacking levers upward;

completing stacking a predetermined quantity of the articles on the base plate as the base plate moves downward and the retaining fork moves to the working position on an uppermost article of the stack of the articles; and placing the stack of articles in the packaging device.

16. The machine according to claim 13, wherein the second carriage faces the pair of pre-stacking levers on the opposite side of the stacking channel, and wherein the base plate that supports the articles is located at a bottom end of the second carriage and is associated with a free end of a C-shaped supporting pin protruding laterally from the second carriage to enable the base plate to be positioned at a center of the stacking channel and passing through a side of the stacking channel.

17. The machine according to claim 13, wherein the retaining fork is positioned at a front of the stacking channel and is movable into the stacking channel, and wherein the retaining fork is pivoted toward the second carriage and is movable between an idle position in which the retaining fork is positioned at an angle outside the stacking channel, and a working position in which the retaining fork is positioned inside the stacking channel and holds the stack of articles in place until the articles are placed in the packaging device.

18. A machine for making and packaging articles containing an infusion product, the machine being defined by a production line and comprising:

a plurality of operating stations arranged in a series relative to each other and designed to make at least one continuous strip by superposing and sealing two webs of filter paper with measured quantities or charges of infusion product interposed between the two webs at regular intervals;

at least one cutting station for dividing the strip to form a succession of individual articles; and at least one built-in packaging station for packaging groups of the articles in packets, wherein the built-in packaging station is located immediately downstream of the cutting station and includes a packaging device for forming stacks of articles and a transfer device which guides the stacks of articles along a vertical feed path section in a direction that is transverse relative to the production line and feeds the stacks of articles into the packets, and wherein the transfer device comprises guide and controlled downfeed means which comprise:

a vertical channel formed by a hollow element, wherein the channel has at least one zone for the passage of the articles; and an element for pushing/accompanying the articles, which is positioned above the hollow element and which is vertically mobile between an idle end position where the element is away from an opening at a top of the hollow element so as to enable the packaging device to be positioned at the top opening, and a working end position where the element guides and pushes the articles, sliding along an inside of the channel so as to position the articles in the packet.

19. The machine according to claim 18, wherein a cross-sectional profile of the channel defines two adjacent circular zones.

20. The machine according to claim 19, wherein the two circular zones have a diameter that is smaller than a maximum dimension of the articles to control and guide the articles as the articles are pushed down along the channel.

21. The machine according to claim 19, wherein the hollow element includes a longitudinal conduit for conveying a fluid positioned centrally between the two circular zones and leading into at least one bottom opening through which the fluid itself is fed into the hollow element in such a way as to blow the fluid onto the articles as the articles move down along the channel.

22. The machine according to claim 21, wherein the fluid is nitrogen.

23. The machine according to claim 18, wherein each zone of the circular zones has a plurality of radial grooves around a circumference thereof that extend along a full length of the circular zones.

24. The machine according to claim 18, wherein the pushing/accompanying element comprises a flat head designed to come into contact with the articles so as to push and guide the articles down the circular zones.

25. The machine according to claim 24, wherein the flat head is associated with a vertical rod that slides along guides associated with a vertical column located above the hollow element, wherein the rod is driven by a variable-speed motor positioned at a top end of the column.

26. The machine according to claim 18, wherein a sealing and cutting unit is positioned at a lower end of the hollow element and is designed to close the inlet opening of the packet positioned under the hollow element and to simultaneously form the base of a next packet being formed around the hollow element.

* * * * *